US011154736B2

(12) United States Patent
Reed

(10) Patent No.: US 11,154,736 B2
(45) Date of Patent: Oct. 26, 2021

(54) FIRE OR SMOKE BARRIER

(71) Applicant: Coopers Fire Ltd., Havant (GB)

(72) Inventor: James Martin Reed, Alverstoke (GB)

(73) Assignee: Coopers Fire Limited, Havant (GB)

( * ) Notice: Subject to any disclaimer, the term of this patent is extended or adjusted under 35 U.S.C. 154(b) by 182 days.

(21) Appl. No.: 16/062,270

(22) PCT Filed: Dec. 12, 2016

(86) PCT No.: PCT/GB2016/053918
§ 371 (c)(1),
(2) Date: Jun. 14, 2018

(87) PCT Pub. No.: WO2017/103576
PCT Pub. Date: Jun. 22, 2017

(65) Prior Publication Data

US 2018/0369623 A1 Dec. 27, 2018

(30) Foreign Application Priority Data

Dec. 14, 2015 (GB) ..... 1521992

(51) Int. Cl.
*A62C 2/10* (2006.01)
*E06B 9/13* (2006.01)
(Continued)

(52) U.S. Cl.
CPC ..... *A62C 2/10* (2013.01); *A62C 2/12* (2013.01); *A62C 2/18* (2013.01); *A62C 2/242* (2013.01);
(Continued)

(58) Field of Classification Search
CPC .... A62C 2/06; A62C 2/10; A62C 3/00; E04B 1/94; E04B 1/946; E04B 1/948; E06B 7/32; E06B 7/02; E06B 7/10; E06B 9/13
See application file for complete search history.

(56) References Cited

U.S. PATENT DOCUMENTS 3,283,691 A * 11/1966 Reiter ..... A62C 2/06 137/75
3,877,525 A * 4/1975 Husson ..... A62C 2/10 169/48
(Continued)

FOREIGN PATENT DOCUMENTS

CN 2292153 Y 9/1998
CN 2607157 Y 3/2004
(Continued)

OTHER PUBLICATIONS

Notice of Reasons for Refusal, Japenese Patent Application 2018-549634, dated Nov. 30, 2020.

*Primary Examiner* — Tuongminh N Pham
(74) *Attorney, Agent, or Firm* — Bay State IP, LLC

(57) ABSTRACT

A fire or smoke barrier (1) having a head box (2) for housing a curtain (4) which is open at its underside to allow the curtain to be deployed and withdrawn. The head box (2) houses a roller (3) for the curtain (4) to be rolled from for deployment and rolled back onto for withdrawal and attached at the bottom of the curtain (4) is a bottom bar (7) for weighing down the curtain (4) when deployed. The head box (2) has one or more apertures (14, 15) for cleaning air circulation and being provided at the, or each, aperture (14,15) with a spring (22) loaded trap (16,17) normally held open by a fusible link (31), the link fusing (31) in event of fire.

12 Claims, 5 Drawing Sheets

(51) Int. Cl.

| | |
|---|---|
| ***E06B 9/17*** | (2006.01) |
| ***A62C 2/12*** | (2006.01) |
| ***A62C 2/18*** | (2006.01) |
| ***A62C 2/24*** | (2006.01) |
| ***E06B 9/58*** | (2006.01) |

(52) U.S. Cl.
CPC ..... *E06B 9/13* (2013.01); *E06B 9/17007* (2013.01); *E06B 9/58* (2013.01); *E06B 2009/17038* (2013.01)

(56) References Cited

U.S. PATENT DOCUMENTS

| | | | | |
|---|---|---|---|---|
| 6,342,004 | B1 * | 1/2002 | Lattimore | A62C 2/245 169/48 |
| 2009/0266498 | A1 * | 10/2009 | Cooper | E06B 9/13 160/309 |

FOREIGN PATENT DOCUMENTS

| | | | |
|---|---|---|---|
| CN | 201040155 | Y | 3/2008 |
| CN | 204662879 | U | 9/2015 |
| DE | 20 2007 015361 | U1 | 2/2008 |
| EP | 2556857 | A1 | 2/2013 |
| JP | S5041314 | U | 4/1975 |
| JP | S5343796 | U | 4/1978 |
| JP | S5360699 | U | 5/1978 |
| JP | S63186449 | U | 11/1988 |
| JP | 10080500 | A | 3/1998 |
| JP | 2000054763 | A | 2/2000 |
| WO | 0120961 | A1 | 1/1991 |
| WO | 2014/135863 | A1 | 9/2014 |

* cited by examiner

FIRE OR SMOKE BARRIER

CROSS REFERENCE TO RELATED APPLICATION

This application is for entry into the U.S. National Phase under § 371 for International Application No. PCT/GB2016/053918 having an international filing date of Dec. 12, 2016, and from which priority is claimed under all applicable sections of Title of the United States Code including, but not limited to, Sections 120, 363, and 365(c), and which in turn claims priority under 35 USC 119 to Great Britain Patent Application No. 1521992.6 filed on Dec. 14, 2015.

The present invention relates to a fire or smoke barrier more particularly, but not exclusively, for a clean room.

Fire and smoke barriers typically comprise:

- a head box for housing a curtain, open at its underside to allow the curtain to be deployed and withdrawn;
- a roller, housed in the head box, for the curtain to be rolled from for deployment and rolled back onto for withdrawal; and
- a bottom bar attached to the bottom of the curtain for weighing down the curtain when deployed.

Normally, the bottom bar closes the open bottom of the head box when the curtain is wound up.

A clean room is an environment with a low level of environmental pollutants such as dust, airborne microbes, aerosol particles, and chemical vapours. Clean rooms are used extensively in semiconductor manufacturing, biotechnology, the life sciences, and other fields that are very sensitive to environmental contamination. Entire manufacturing facilities can be contained within a clean room with factory floors covering thousands of square meters. A clean room has a controlled level of contamination that is generally controlled by a filtration system. The air entering a clean room from the outside is filtered to exclude dust and the air inside is constantly recirculated through high-efficiency particulate air (HEPA) and/or ultra-low particulate air (ULPA) filters to remove internally generated contaminants.

The object of the present invention is to provide a fire or smoke barrier that is suitable for use in clean room.

According to the invention there is provided a smoke or fire barrier comprising:—

- a head box for housing a curtain, open at its underside to allow the curtain to be deployed and withdrawn;
- a roller, housed in the head box, for the curtain to be rolled from for deployment and rolled back onto for withdrawal; and
- a bottom bar attached to the bottom of the curtain for weighing down the curtain when deployed, the head box having

- one or more apertures for cleaning air circulation and being provided at the or each aperture with
- a spring loaded trap normally held open by a fusible link, the link fusing in event of fire.

With the barrier installed in a clean room, to avoid contamination from within the head box passing into the clean room, clean filtered air can be circulated through is the head box to reduce the need for a person to clean inside the head box. The air circulated via apertures can keep the head box clean. It is to avoid the aperture(s) providing a fire route that the fusible trap(s) are provided.

Whilst we can envisage that a single aperture only might be provided, for instance where the cleaning air circulation is drawn into the head box via its opening as clean air from the clean room, we prefer to provide two apertures one for admission of the clean air to the head box and the other for withdrawal of this cleaning air from the head box, both being provided with spring loaded fusible link traps.

Normally, the aperture will be provided on the topside of head box with the traps also fitted to the top of the box. Air duct end fittings can be provided to enclose the traps route the air to and from the apertures. The ducts will be connected to a clean air circulating system, typically including a filter such as a HEPA or ULPA filter. The design of the system per se will be within the capabilities of the skilled reader and will not be described further. Normally the fusible link will be such as to rupture between 57-150° C.

The trap can have a fixed guide, typically formed as a sheet metal pressing, for a moveable trap member, with a spring acting between the guide and the trap member. Typically the spring loaded trap will include at least two springs. The guide can have an upstand at one end with the trap having a complementary upstand and the, or a plurality of, springs acting between them. The guide can have an abutment for regulating the closed position in the trap. The guide can have an aperture complementary to the aperture on the head box. The guide can have C-shaped channels along its edges to guide the trap over the aperture.

The fusible link can be attached to the fixed guide and movable trap member. The fusible link can be formed of two portions attached by a fusible material, one portion being attached to the guide and the other portion to the trap member to allow closure of the trap member on sufficient temperature rise. The portions can be held together by a material having a low melting point range typically between 57-150° C. The two portions of the fusible link are normally held together, but on sufficient temperature rise, the material will melt, releasing the portions of the fusible link and allowing the trap member to close the aperture in the head box.

To help understanding of the invention, a specific embodiment thereof will now be described by way of example and with reference to the accompanying drawings, in which.

Figure 1:
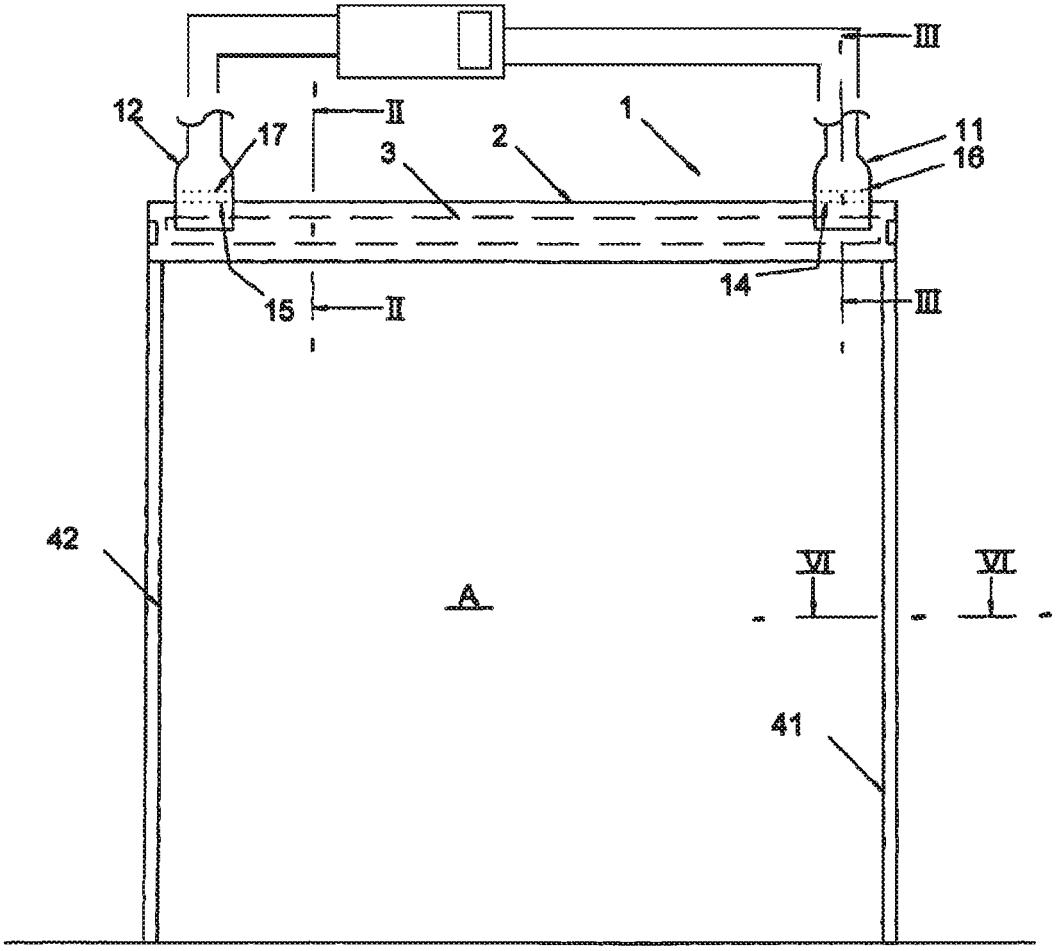
FIG. 1 is a front view of a fire and smoke barrier according to the present invention.
Figure 2:
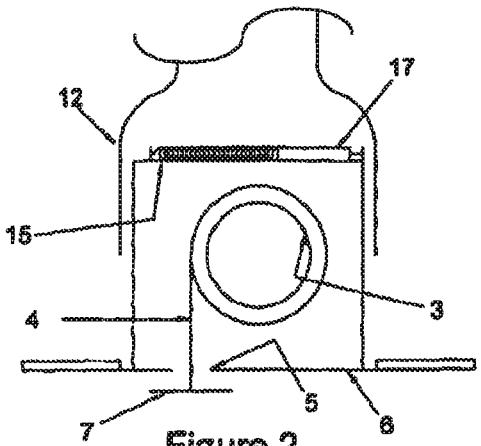
FIG. 2 is a cross-sectional view on the line II-II in FIG. 1 of the head box of the barrier of FIG. 1.
Figure 3:
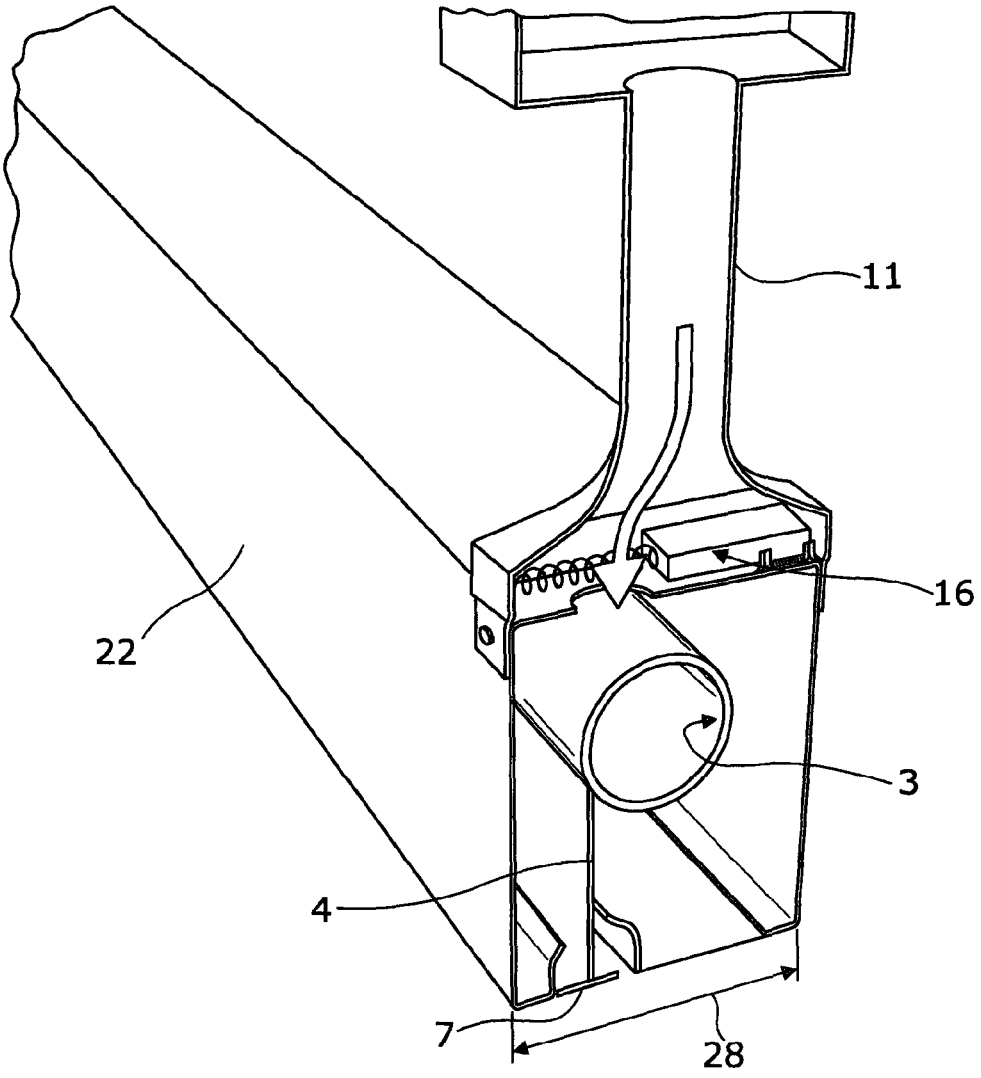
FIG. 3 is a perspective view similar to FIG. 2 at line of FIG. 1.
Figure 4:
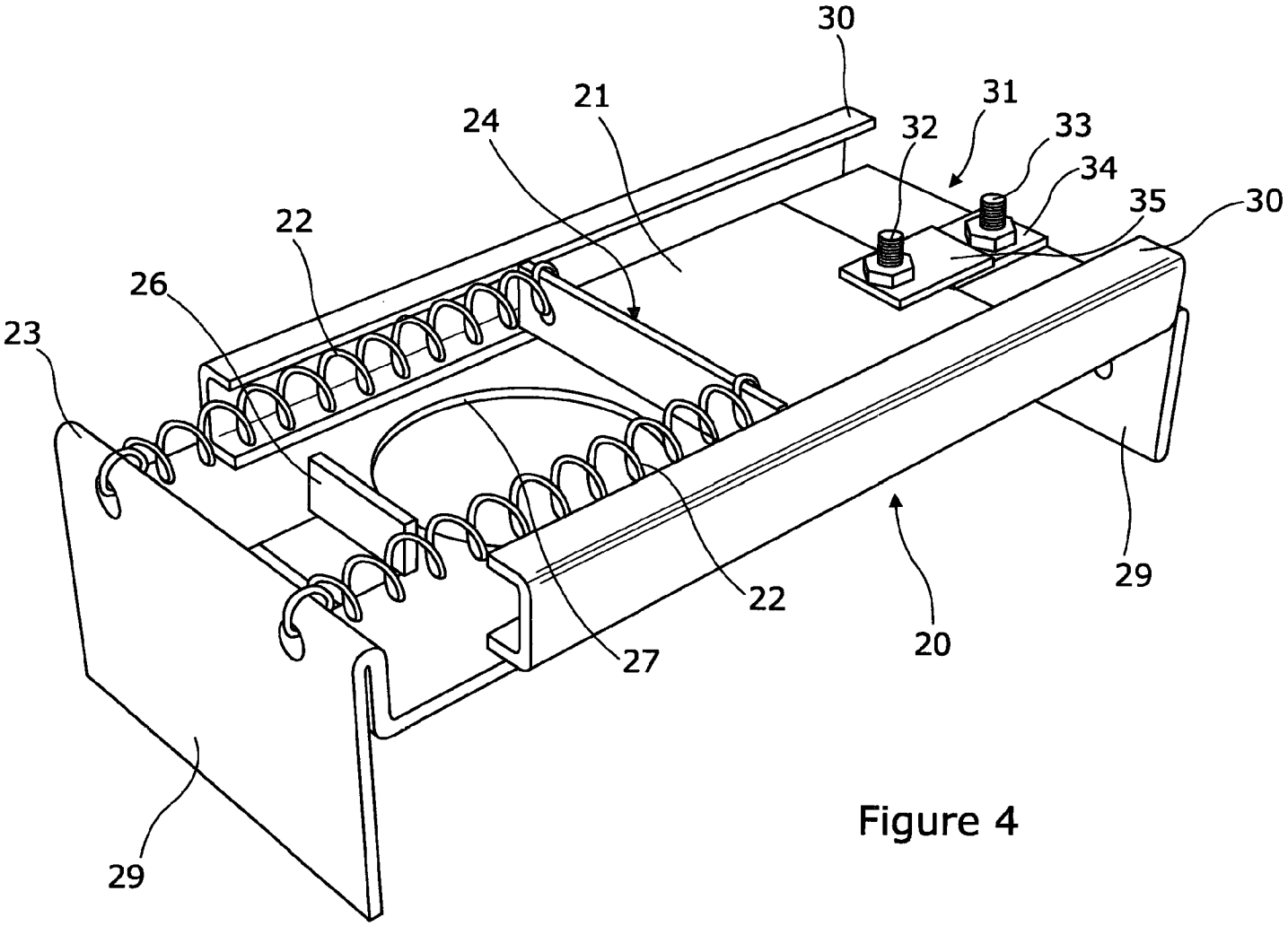
FIG. 4 is a perspective view of a spring loaded trap shown open in FIG. 3.
Figure 5:
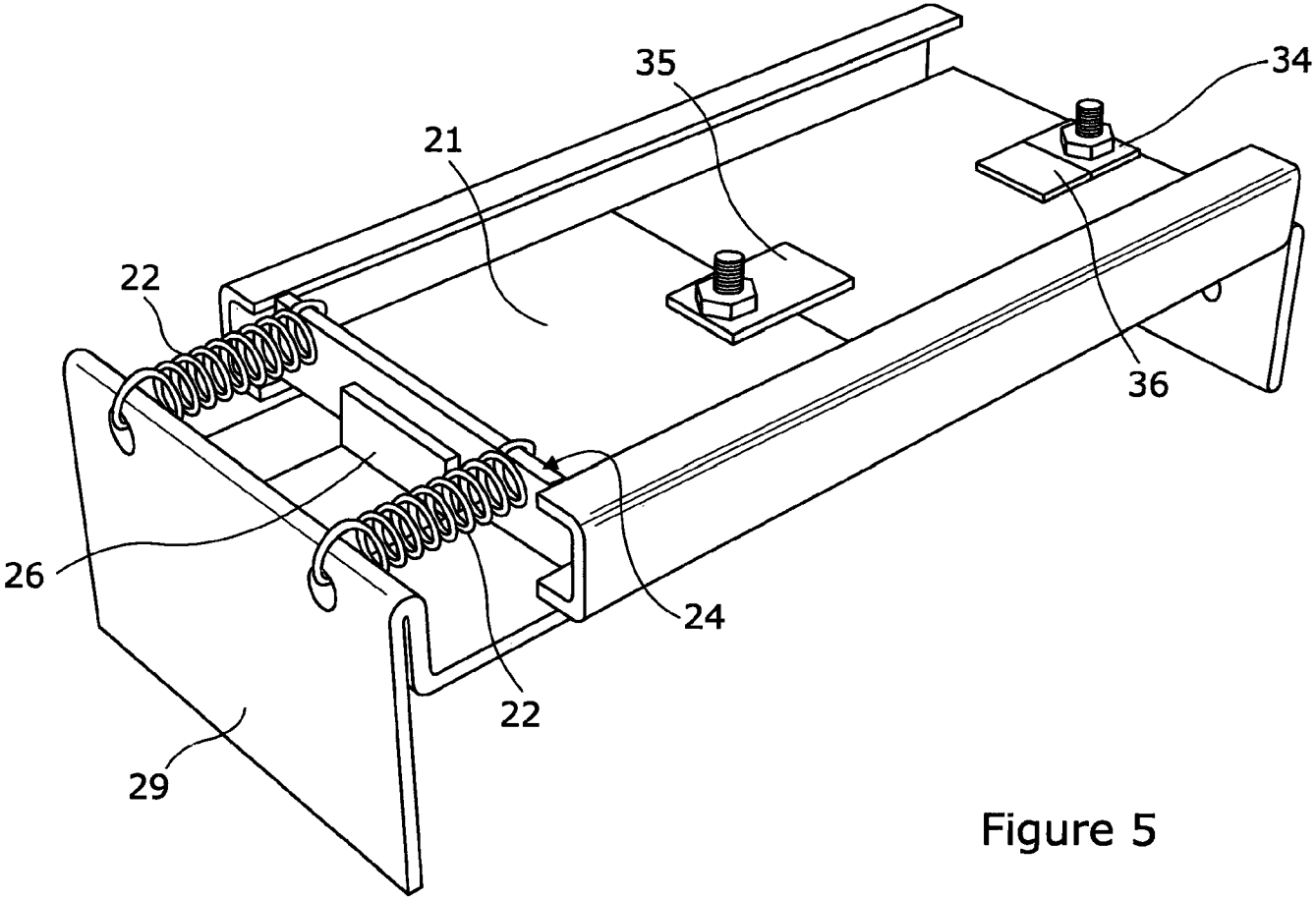
FIG. 5 is a perspective view of the spring loaded trap when closed.
Figure 6:
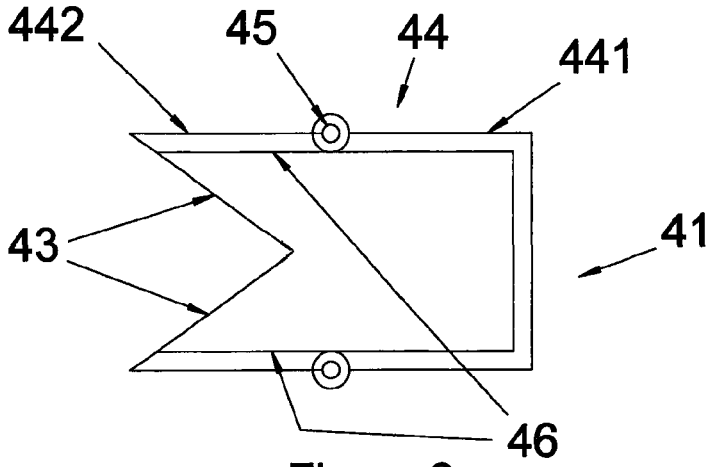
FIG. 6 is a cross-sectional plan view on the line VI-VI of a side guide of the barrier of FIG. 1.
Figure 7:
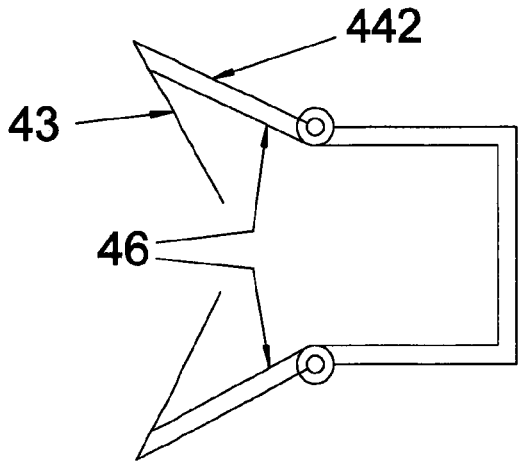
FIG. 7 is a similar view of the side guide open for cleaning.

Referring to the drawings, a smoke or fire barrier 1 has a head box 2, mounted in use in a ceiling C at a building aperture A. A roller 3 is arranged in the head box 2 and has a curtain 4 rolled onto it. The curtain extends through an opening 5 in the bottom 6 of the head box which is flush with the ceiling. Normally a bottom bar 7 closes the opening. The roller incorporates a motor and brake for controlling unrolling of the curtain to the floor under the weight of the bottom bar and rewinding. The barrier is conventional in this respect and its conventional features will not be described further.

In accordance with the invention, the head box 2 is provided with two air duct end fittings 11,12 for passing clean air into and out of it for purging it of any contaminants, which might otherwise accumulate in it. The head box has apertures 14,15 for air to pass from the fittings to its interior. Remote from the fittings non-shown ducts and conventional means for the supply of clean, filtered air are provided. These apertures, the fittings and indeed ducts provide a potential route for fire to pass into the clean room in which the barrier is installed.

At each aperture, a respective spring loaded trap 16,17 is provided with a fusible link, whereby normally the head box can have clean air circulated through it, but in event of fire the apertures are closed.

Each spring loaded trap 16,17 has a fixed guide 20, typically formed as a sheet metal pressing, for a moveable trap member 21, with two springs 22 acting between the guide 20 and the trap member 21. The guide 20 has an upstand 23 at one end with the trap 21 having a complementary upstand 24 and the springs 22 acting between them. The guide 20 also has an abutment 25 for regulating the closed position 26 in the trap 16,17. The guide has an aperture 27 aligned with the respective apertures 14,15 in the head box 2. The guide 20 extends across the width 28 of the head box and is located by down-turned flanges 29 fixed to the head box. It includes C-shaped channels 30 along its edges to guide the movable member 21 as it closes the apertures. The channels and the upstands locate the air duct end fittings.

The fusible link 31 extends between respective studs 32,33 attached to the fixed guide 20 and movable trap member 21 and normally holds the trap member from closing the apertures. It is formed of two portions 34,35 attached by a fusible material 36, having a low melting point range typically between 57-150° C. On temperature rise due to fire, the material 36 melts, releasing the portions 34,35 of the fusible link 10 and allowing the trap member to close the respective apertures 14,15 in the head box 2 and the aperture 27 on the spring loaded trap 16,17.

At the sides of the building aperture A, side guides 41,42 are provided for retaining the edges of the curtain when deployed by engagement with conventional edge studs or the like not shown. The side guides have in-turned lips 43 for this purpose. These extend from flanges 44 defining with an inner web a U-section channel, down which the respective edges of the curtain pass on deployment. The flanges are each divided into outer and inner strips 441,442 with a hinge 45 between them extending the height of the guides, with springs 46 biasing the outer strips to take up a position with the interned lips parted just sufficiently for the curtain to deploy.

For periodic cleaning of the side guides, they can be hinged open and swabbed down.

The invention claimed is:

1. A smoke or fire barrier having a curtain comprising:

a head box for housing the curtain, open at its underside to allow the curtain to be deployed and withdrawn;

a roller, housed in the head box, for the curtain to be rolled from for deployment and rolled back onto for withdrawal; and a bottom bar attached to a bottom of the curtain for weighing down the curtain when deployed, wherein the bottom bar closes the open underside of the head box when the curtain is withdrawn;

the head box having:

two air duct end fittings for passing clean air;

two apertures for clean filtered air circulation, one of the two aperture for admission of clean air to the head box and the other aperture of the two apertures for withdrawal of the air from the head box, wherein each said aperture is provided on a topside of the head box with a spring loaded trap also fitting to the topside of the head box, wherein each said spring loaded trap is normally held open by a fusible link, the link fusing in event of fire; and wherein each said spring loaded trap and each said aperture are provided within each said air duct end fitting.

2. A smoke or fire barrier as claimed in claim 1, including a supply of clean air to be circulated through the head box to keep the head box clean.

3. A smoke or fire barrier as claimed in claim 1, wherein air ducts route the air to and from the two apertures.

4. A smoke or fire barrier as claimed in claim 3, wherein the air ducts are connected to a clean air circulation via a filter.

5. A smoke or fire barrier as claimed in claim 1, wherein the fusible link will be such as to rupture between 57-150° C.

6. A smoke or fire barrier as claimed in claim 1, wherein each said spring loaded trap has a fixed guide, typically formed as a sheet metal pressing, for a moveable trap member, with at least one spring acting between the guide and the trap member.

7. A smoke or fire barrier as claimed in claim 1, wherein each said spring loaded trap will include at least two springs.

8. A smoke or fire barrier as claimed in claim 6, wherein the guide has an upstand at one end with each said spring loaded trap having a complementary upstand and a plurality of springs acting between them.

9. A smoke or fire barrier as claimed in claim 6, wherein the guide has:

an abutment for regulating the closed position in each said spring loaded trap; and/or an aperture complementary to the aperture on the head box; and/or C-shaped channels along edges of the guide to guide each said spring loaded trap over the two apertures.

10. A smoke or fire barrier as claimed in claim 6, wherein the fusible link can be attached to the fixed guide and movable trap member.

11. A smoke or fire barrier as claimed in claim 6, wherein the fusible link can be formed of two portions attached by a fusible material, one of the two portions being attached to the guide and the other portion attached to the trap member to allow closure of the trap member on a rise in temperature, the two portions of the fusible link are normally held together, but on sufficient temperature rise, the material will melt, releasing the two portions of the fusible link and allowing the trap member to close the two apertures in the head box.

12. A smoke or fire barrier as claimed in claim 11, wherein the two portions can be held together by a material having a low melting point range typically between 57-150° C.

* * * * *